US010463942B1

(12) United States Patent
Chien

(10) Patent No.: US 10,463,942 B1
(45) Date of Patent: Nov. 5, 2019

(54) SPHERE-LAUNCHING APPARATUS

(71) Applicant: HENG AN CO., LTD., Nantou County (TW)

(72) Inventor: Kun-Lin Chien, Nantou County (TW)

(73) Assignee: HENG AN CO., LTD., Nantou County (TW)

( * ) Notice: Subject to any disclaimer, the term of this patent is extended or adjusted under 35 U.S.C. 154(b) by 0 days.

(21) Appl. No.: 15/984,568

(22) Filed: May 21, 2018

(51) Int. Cl.

| | |
|---|---|
| ***A63B 69/40*** | (2006.01) |
| *A63B 102/02* | (2015.01) |
| *A63B 102/32* | (2015.01) |
| *A63B 102/18* | (2015.01) |
| *A63B 102/16* | (2015.01) |

(52) U.S. Cl.
CPC ..... *A63B 69/409* (2013.01); *A63B 2102/02* (2015.10); *A63B 2102/16* (2015.10); *A63B 2102/18* (2015.10); *A63B 2102/32* (2015.10)

(58) Field of Classification Search
CPC ..... A63B 69/409; A63B 2102/02; A63B 2102/16; A63B 2102/18; A63B 2102/32; F41B 11/721; F41B 11/62; F41B 11/00
USPC ..... 124/75
See application file for complete search history.

(56) References Cited

U.S. PATENT DOCUMENTS 5,497,650 A * 3/1996 Chien ..... G01N 3/307 73/12.07
6,415,671 B1 * 7/2002 Chien ..... G01N 3/40 73/865.9
6,418,920 B1 * 7/2002 Marr ..... F41B 11/721 124/73
6,601,780 B1 * 8/2003 Sheng ..... F41B 11/52 239/337
6,763,822 B1 * 7/2004 Styles ..... F41A 7/08 124/32
7,597,097 B2 * 10/2009 Gan ..... F41B 11/721 124/73
7,624,727 B2 * 12/2009 Campo ..... F41B 11/57 124/32
7,849,725 B1 * 12/2010 Nelson ..... A63B 47/008 73/12.05
2001/0042543 A1 * 11/2001 Perrone ..... F41B 11/52 124/77
2004/0154600 A1 * 8/2004 Jong ..... F41B 11/52 124/74
2005/0005924 A1 * 1/2005 Sheng ..... F41B 11/52 124/74

(Continued)

*Primary Examiner* — Joshua E Freeman
(74) *Attorney, Agent, or Firm* — WPAT, PC

(57) ABSTRACT

A sphere-launching apparatus includes a launching tube defining a launching passage, a push unit having a push rod and a first driving device, and a pneumatic unit having a valve mechanism, a pneumatic cylinder and an air container. The push rod, to protrude axially into the launching passage, has a third axial end and an opposing fourth axial end for contacting a sphere in the launching tube. The first driving device, connected with the third axial end, controls the push rod to move the sphere along the launching passage to a predetermined position. The valve mechanism has an air-emitting end connected spatially with the launching passage. The pneumatic cylinder drives the valve mechanism to block or open the air-emitting end. When the valve mechanism opens the air-emitting end, a compressed air in the air container is discharged into the launching passage to eject the sphere out of the launching tube.

9 Claims, 5 Drawing Sheets

(56) References Cited

U.S. PATENT DOCUMENTS

2005/0011505 A1* 1/2005 Nygaard ..... F41A 19/58 124/31
2005/0268894 A1* 12/2005 Styles ..... F41B 11/57 124/74
2006/0011188 A1* 1/2006 Jones ..... F41B 11/73 124/77
2006/0162716 A1* 7/2006 Dobbins ..... F41A 19/12 124/77
2007/0012214 A1* 1/2007 Yeh ..... F41B 11/62 102/502
2007/0209650 A1* 9/2007 Jones ..... F41B 11/73 124/73
2007/0215133 A1* 9/2007 Jones ..... F41B 11/57 124/73
2007/0267005 A1* 11/2007 Yeh ..... F41B 11/721 124/74
2008/0087265 A1* 4/2008 Yeh ..... F41B 11/62 124/71
2008/0087266 A1* 4/2008 Yeh ..... F41B 11/62 124/73
2009/0095271 A1* 4/2009 Jones ..... F41B 11/721 124/77
2009/0145413 A1* 6/2009 Li ..... F41B 11/721 124/73
2009/0308371 A1* 12/2009 Lian ..... F41B 11/57 124/77
2010/0065032 A1* 3/2010 Yang ..... F41B 11/57 124/27
2010/0212648 A1* 8/2010 Tseng ..... F41B 11/73 124/39
2013/0192576 A1* 8/2013 Ma ..... F41B 9/0037 124/73
2015/0020787 A1* 1/2015 Tseng ..... F41B 11/00 124/73
2015/0059724 A1* 3/2015 Yang ..... F41B 11/646 124/66
2015/0323281 A1* 11/2015 Gonzaga ..... F41B 6/006 124/3

* cited by examiner

SPHERE-LAUNCHING APPARATUS

BACKGROUND OF THE INVENTION

(1) Field of the Invention

The invention relates to a sphere-launching apparatus, and more particularly to the sphere-launching apparatus that can have all spheres or spheroids it carries to be launched at the same initial position and by the same speed.

(2) Description of the Prior Art

Currently, various ball-launching machines have been already seen in the marketplace to launch spheres or spheroids, such as tennis balls, baseballs, gulf balls and pingpong balls, and helpfully to facilitate ball games and/or training.

A typical conventional ball-launching machine mainly includes a launching tube. One lateral side of the launching tube is usually connected spatially with a ball-supplying duct for providing spheres to enter the launching tube. An axial end of the launching tube is generally furnished with a compressed-air launching device that is further connected with an air container. While a compressed air inside the air container is quickly released, one axial end of the compressed-air launching device would generate an impulsive push, parallel to an axial direction of the launching tube, onto a sphere. Then, the sphere would be ejected via another axial end of the launching tube.

Conventionally, a pressure inside the air container can be adjusted to vary a leaving speed of the sphere. Ideally, as long as the setting of the machine is determined, all the spheres can be ejected continuously at the same angle, direction and distance. However, due to some unexpected structural factors, angles, directions and distances of the ejected spheres can't be kept the same, or even within acceptable ranges.

For example, since variations do exist in outer diameters of different spheres, so when these spheres are individually loaded into the launching tube, a distance between each the sphere and the air-emitting end of the compressed-air launching device might vary. When the diameter of one sphere is less than an inner diameter of the launching tube, this sphere can roll freely to a lower place of the launching tube. However, if the diameter of another sphere is larger than the inner diameter of the launching tube, this another sphere might be jammed in the launching tube. Obviously, different initial launching positions would be met in these two spheres, and the launch velocities thereof would be different as well.

In addition, when the air pressure is suddenly released, an impulsive airflow will be generated to lift the the sphere, and thereby the sphere would hit the sidewall of the launching tube and/or a corresponding junction with a sphere-feeding pipe, thus velocity variations among the spheres would become wider.

Accordingly, an improved sphere-launching apparatus that can ensure the initial launch position and launch velocity of the sphere is definitely urgently needed in the art.

SUMMARY OF THE INVENTION

In one embodiment of the present invention, a sphere-launching apparatus includes a launching tube, a push unit and a pneumatic unit.

The launching tube has a first axial end and a second axial end located oppositely to the first axial end. The launching tube defines thereinside a launching passage connected spatially the first axial end and the second axial end.

The push unit, mounted to the first axial end, includes a push rod and a first driving device. The push rod, to protrude into the launching passage of the launching tube in an axial and parallel manner, has a third axial end and a fourth axial end located oppositely to the third axial end. The fourth axial end is to touch and push a sphere in the launching tube. The first driving device, connected with the third axial end of the push rod, is to control the push rod to push the sphere to move axially along the launching passage in the launching tube to a predetermined position.

The pneumatic unit includes a valve mechanism, a pneumatic cylinder and an air container. The valve mechanism has an air-emitting end connected spatially with the launching passage. The pneumatic cylinder, connected with another end of the valve mechanism by being located oppositely to the launching passage, is to drive the valve mechanism to block or open the air-emitting end. The air container, connected with the valve mechanism, is to store the compressed air. When the valve mechanism opens the air-emitting end, the compressed air stored in the air container would be released into the launching passage so as to eject the sphere out of the launching tube via the second axial end.

All these objects are achieved by the sphere-launching apparatus described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a sphere-launching apparatus. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
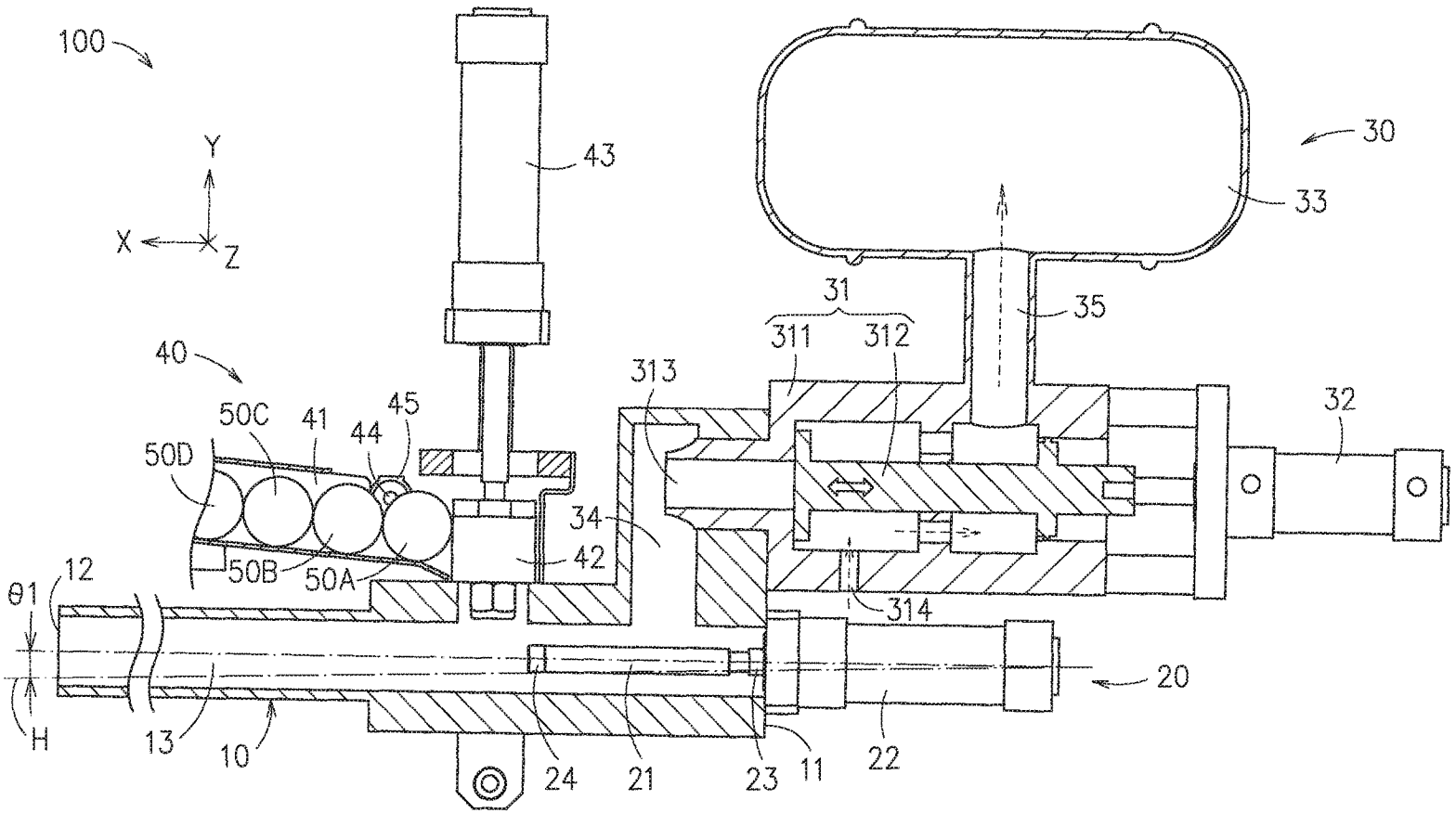
FIG. 1 is a schematic cross-sectional view of a preferred embodiment of the sphere-launching apparatus in accordance with the present invention.

Referring now to FIG. 1, the sphere-launching apparatus 100 mainly includes a launching tube 10, a push unit 20 and a pneumatic unit 30.

As shown in FIG. 1, the launching tube 10 has a first axial end 11 and a second axial end 12 located oppositely to the first axial end 11. Inside the launching tube 10, a launching passage 13 is defined to communicate spatially the first axial end 11 and the second axial end 12. An axial (i.e., longitudinal) direction of the launching tube 10 (X direction) forms an angle θ1 with respect to a horizontal surface H. An elevation of the second axial end 12 is higher than that of the first axial end 11, such that the launching tube 10 can present an elevation state with respect to the angle θ1. In the present invention, the determination of the angle θ1 is per requirements, for example θ1≥1.5°.

As shown in FIG. 1, the push unit 20, located at the first axial end 11, includes a push rod 21 and a first driving device 22. While protruding into the launching passage 13, an axial direction (X direction) of the push rod 21 is parallel to that of the launching tube 10. The push rod 21 has a third axial end 23 and a fourth axial end 24 located oppositely to the third axial end 23. The first driving device 22, connected with the third axial end 23 of the push rod 21, is to control the push rod 21 to move axially along and within the launching passage 12 between a standby position and a push position. In the present invention, the first driving device 22 can be a pneumatic cylinder, a hydraulic cylinder, a mechanical device, an electric actuator, or any the like.

As shown in FIG. 1, the pneumatic unit 30 includes a valve mechanism 31, a pneumatic cylinder 32 and an air container 33. The valve mechanism 31 includes a casing 311 and a valve 312. One end of the casing 311 is an air-emitting end 313 connected to the launching passage 13. The pneumatic cylinder 32 is mounted to another end of the casing 311 by opposing to the air-emitting end 313. The valve 312, located inside the casing 311, has one end connected with the pneumatic cylinder 32, while another end of the valve 312 is faced to the air-emitting end 313. The valve 312 of the valve mechanism 31 is driven by the pneumatic cylinder 32 to move with respect to the air-emitting end 313 so as to block or open the air-emitting end 313. In FIG. 1, the air-emitting end 313 is in the block state.

The valve mechanism 31 is connected with one end of an air passage 34, while another end of the air passage 34 is connected spatially with the launching passage 13. An axial (longitudinal) direction of the air passage 34 (Y direction) is perpendicular to the axial direction of the launching tube 13 (X direction), and an air-releasing direction of the air-emitting end 313 (X direction) is perpendicular to the axial direction of the air passage 34 (Y direction). The air container 33 is connected spatially with the valve mechanism 31 via a connection pipe 35. The valve mechanism 31 has a compressed-air injection hole 314 for introducing the compressed air into the valve mechanism 31 and then the air container 33, such that the compressed air can be stored in the air container 33 (the airflow is indicated by dashed arrow lines). At this moment, the air-emitting end 313 is in the block state.

Figure 2:
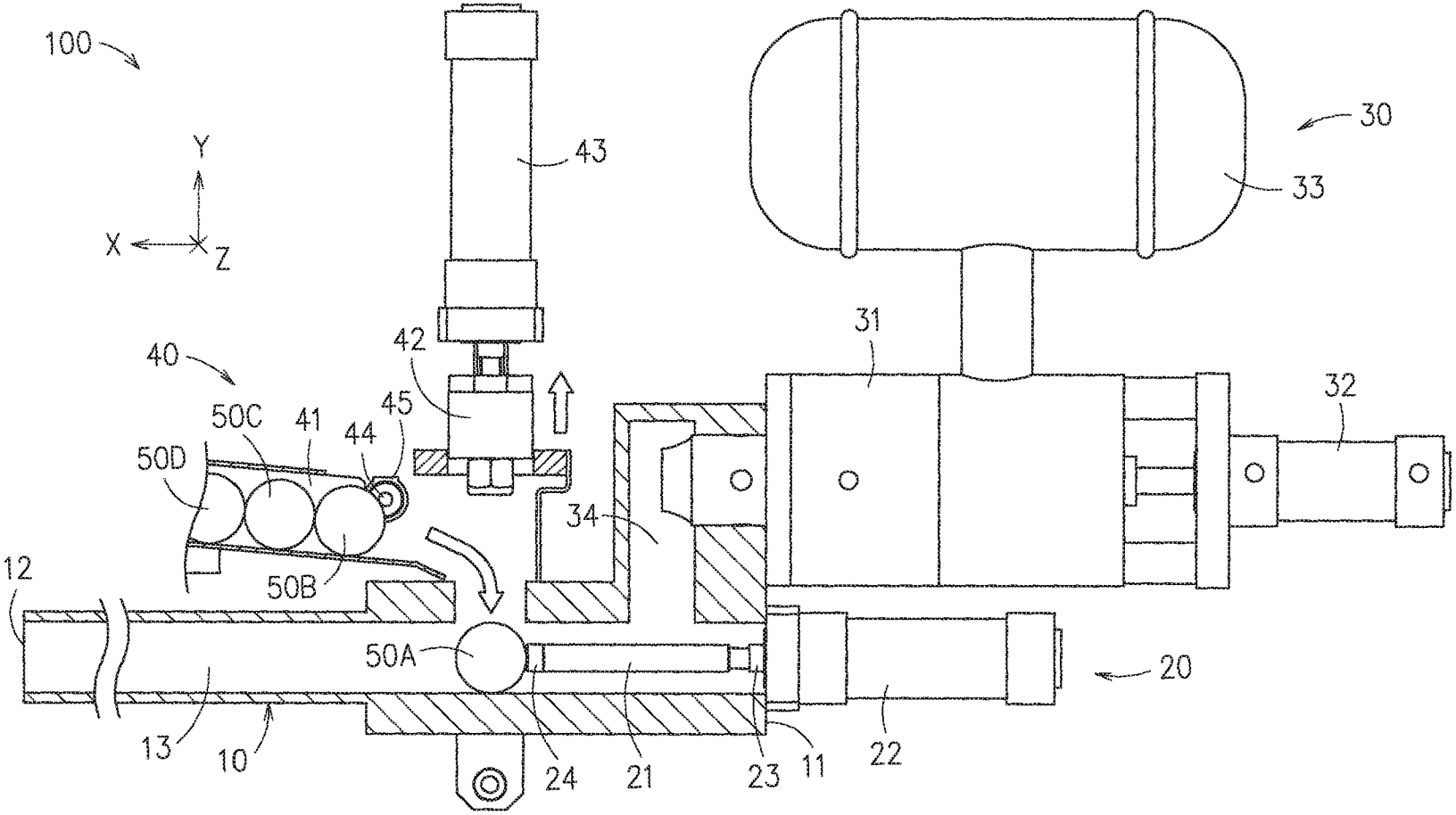
FIG. 2 shows another state of FIG. 1, in which the stop block is moved to an open position and one sphere is right fallen into the launching tube.

Referring now to both FIG. 1 and FIG. 2, the launching tube 10 is connected with a sphere-supplying unit 40 in a bifurcation manner. The sphere-supplying unit 40 includes a sphere-supplying duct 41 and a stop block 42. The sphere-supplying duct 41 for carrying a plurality of spheres 50A-50D, is connected spatially with the launching passage 13. The stop block 42 is mounted to the junction of the sphere-supplying duct 41 and the launching passage 13. The stop block 42 is connected with a second driving device 43. By providing the second driving device 43, the stop block 42 is movable in the Y direction between a block position and an open position. In the present invention, the second driving device 43 can be a pneumatic cylinder, a hydraulic cylinder, a mechanical device, an electric actuator, or any the like. In FIG. 1, the stop block 42 is at the block position to terminate the spatial connection of the sphere-supplying duct 41 and the launching passage 13. In FIG. 2, the stop block 42 is lifted to the open position, such that the sphere-supplying duct 41 and the launching passage 13 are spatially connected. Thereupon, the sphere 50A in the sphere-supplying duct 41 can fall into the launching passage.

Figure 4:
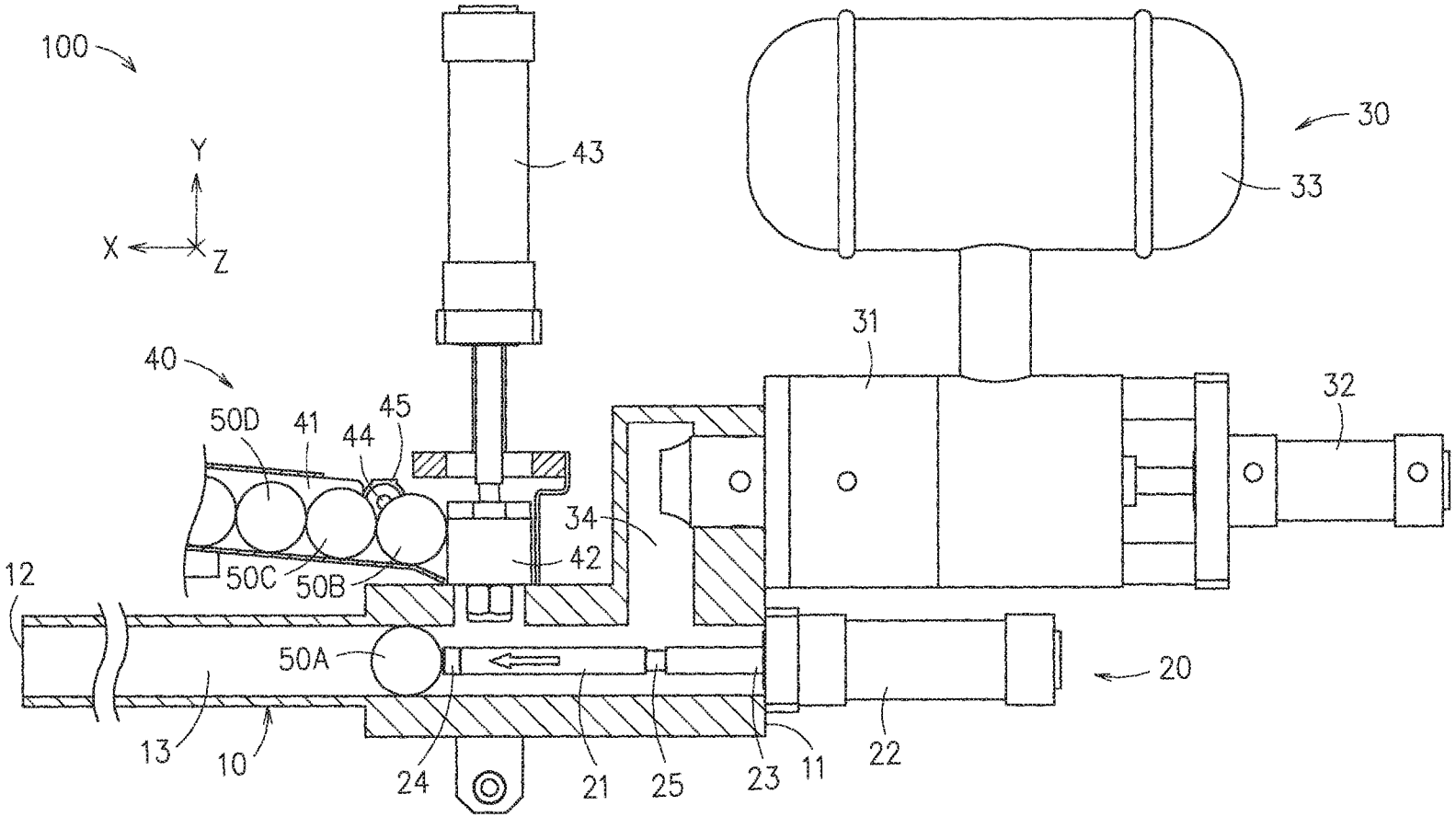
FIG. 4 shows a further state of FIG. 1, in which the stop block is at the block position and the sphere is pushed to a predetermined position by the push rod.

Refer now to FIG. 1 and FIG. 4. In FIG. 1, the push rod 21 is at the standby position, and thus the fourth axial end 24, by closing to the first axial end 11, is located in the sphere-supplying duct 13 at one side of a projection region of the junction of the sphere-supplying duct 41 and the launching passage 13. In FIG. 4, the push rod 21 is at the push position, and thus the fourth axial end 24, by closing to the second axial end 12, is located in the sphere-supplying duct 13 at another side of the projection region of the junction of the sphere-supplying duct 41 and the launching passage 13.

Referring now to FIG. 1 and FIG. 2, in order to ensure that only a single sphere can be fallen into the launching passage 13 in each individual operation, thus a stop rod 44 is introduced. An axial direction of the stop rod 44 (Z direction) is perpendicular to the axial direction of the sphere-supplying duct 13 (X direction). The stop rod 44, connected with a third driving device 45, is controlled by the third driving device 45 to move axially (Z direction) between a protruding position and a retrieving position. In the present invention, the third driving device 45 can be a pneumatic cylinder, a hydraulic cylinder, a mechanical device, an electric actuator, or any the like. In FIG. 1, the stop rod 44 is at the retrieving position, and the spheres 50A-50D are all jammed by the stop block 42 so as unable to enter the launching passage 13. In FIG. 2, the stop block 42 is lifted up to the open position, and the stop rod 44 at the protruding position is protruded into the sphere-supplying duct 41 so as to contact the sphere 50B. Thereupon, the plurality of spheres 50B-50D can be jammed in the sphere-supplying duct 41, so that, in the sphere-supplying duct 41, only the sphere 50A close to the stop block 42 can fall into the launching passage 13.

Referring now to FIG. 1 to FIG. 5, a preferred method for operating the sphere-launching apparatus of the present invention includes the following steps.

Step 1: as shown in FIG. 1, the stop block 42 is at the block position, the spheres 50A-50D are all blocked in the sphere-supplying duct 41, the push rod 21 is at the standby position, the compressed air is limited inside the air container 33, and the air-emitting end 313 is in the block state.

Step 2: as shown in FIG. 2, the stop block 42 is lifted up to the open position, the stop rod 44 at the protruding position blocks the plurality of spheres 50B-50D inside the sphere-supplying duct 41, and the sphere 50A is fallen to the launching passage 13. Since the launching tube 10 has an elevation angle (the angle θ1 shown in FIG. 1), thus the sphere 50A would roll automatically toward the push rod 21 and finally hit the fourth axial end 24.

Figure 3:
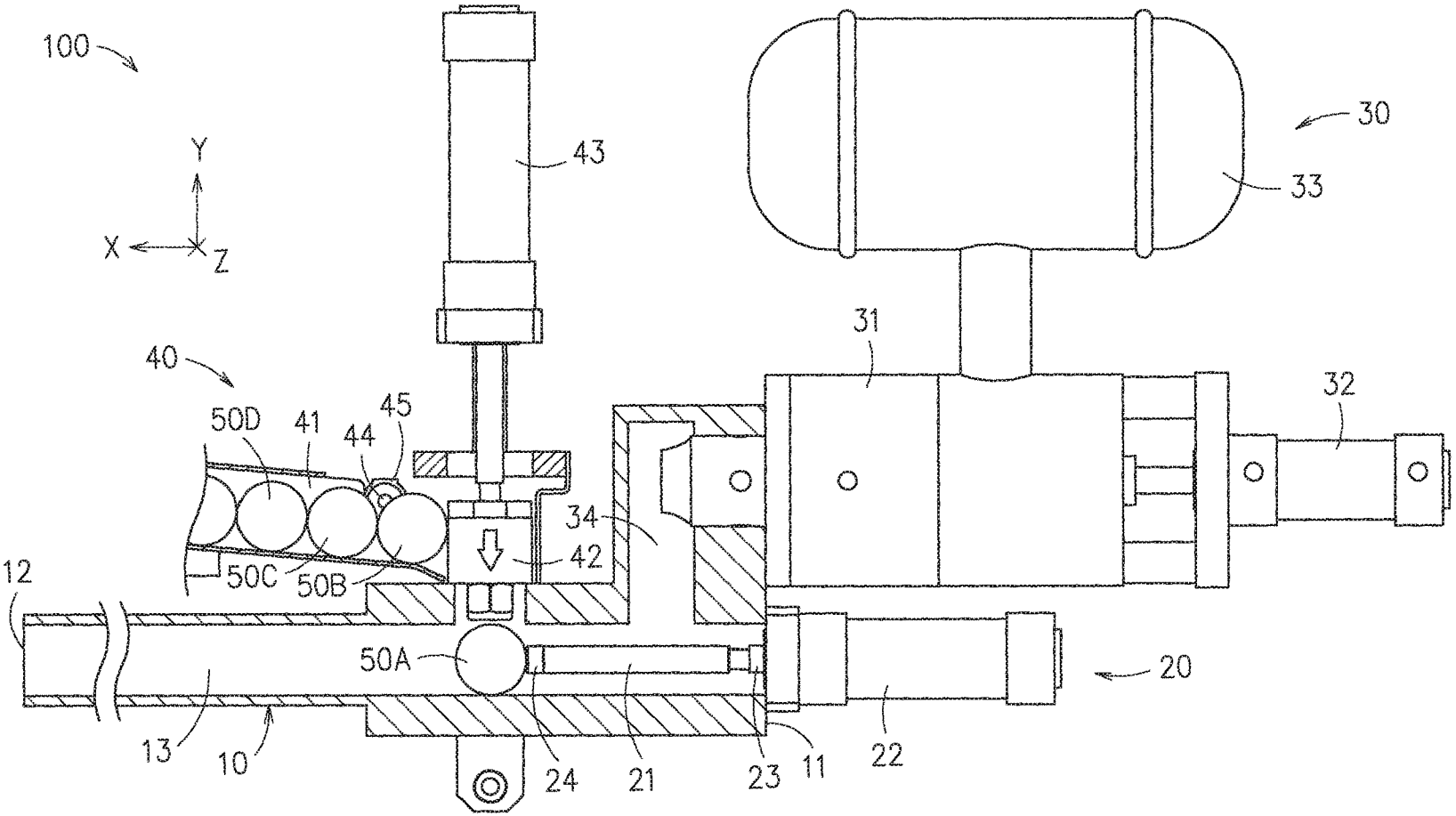
FIG. 3 shows a further state of FIG. 1, in which the stop block is moved to a block position and the sphere is in the launching tube.

Step 3: as shown in FIG. 3, as soon as the sphere 50A is in the launching passage 13, the stop block 42 would be lowered to the block position, and the stop rod 44 is back to the retrieving position.

Step 4: as shown in FIG. 4, the first driving device 22 drives the push rod 21 to the push position, the fourth axial end 24 contacts and pushes the sphere 50A to a predetermined position, so that the sphere 50A can be away from the junction of the sphere-supplying duct 41 and the launching tube 10. As shown, the push rod 21 is furnished with a neck section 25. As the push rod 21 moves the sphere 50A to the predetermined position, the neck section 25 would be right under the junction of the air passage 34 and the launching passage 13.

Figure 5:
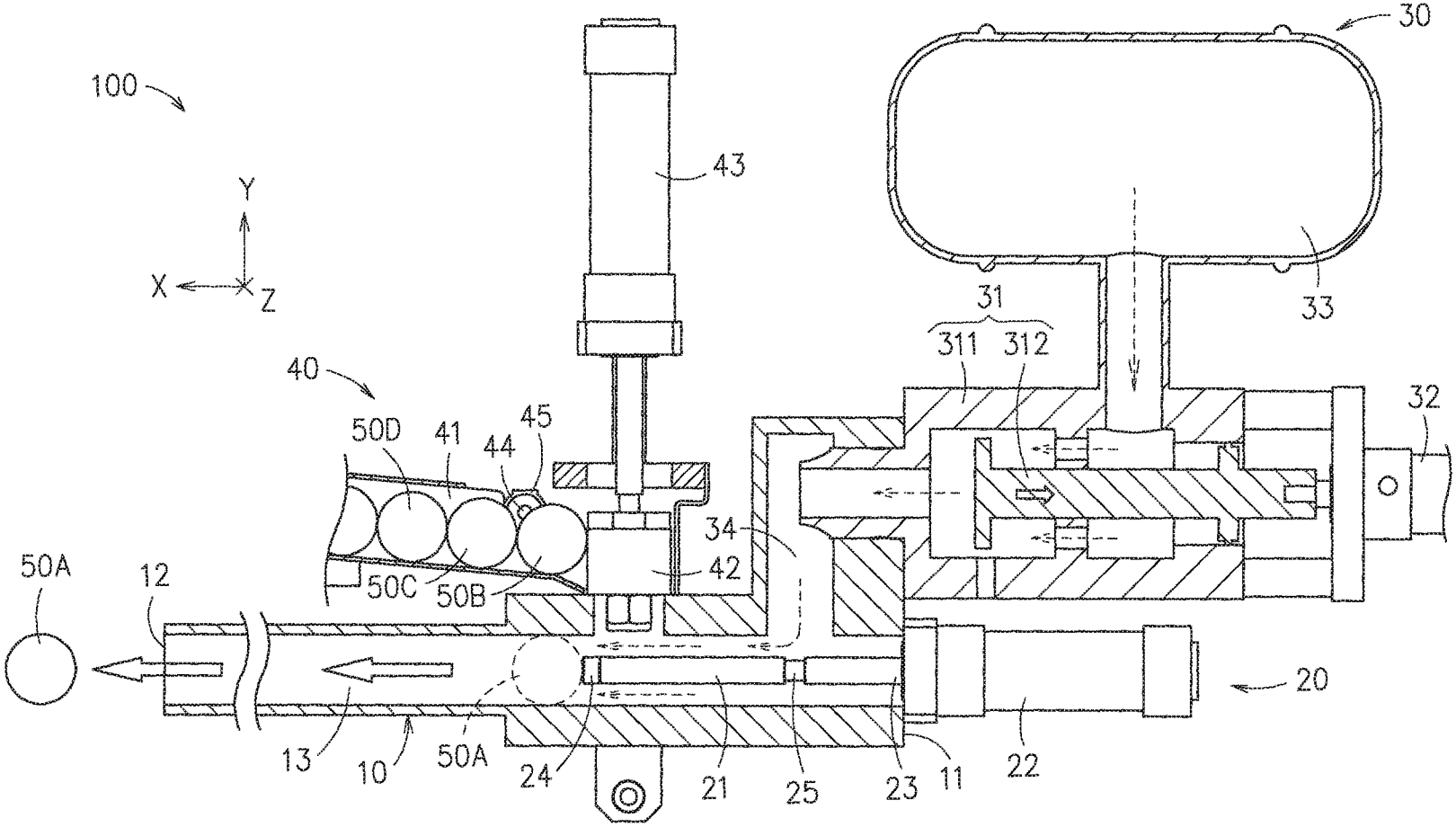
FIG. 5 shows a further state of FIG. 1, in which the compressed air expels the sphere out of the launching tube.

Step 5: as shown in FIG. 5, the pneumatic cylinder 32 pulls the valve 312 so as to open the air-emitting end 313, then the compressed air in the air container 33 would be suddenly released or discharged into the air passage 34 and then the launching passage 13. Thereupon, the sphere 50A would be ejected out of the launching tube 10 via the second axial end 12. By providing the neck section 25 of the push rod 21, resistance against the compressed air to enter the launching passage 13 can be reduced. In this invention, the sphere can be a tennis ball, a baseball, a gulf ball, a pingpong ball or any non-metallic spheroid the like. The inner wall of the launching tube 10 can be finished by minor boring and the chemical Ni heat treatment so as to enhance the smoothness, and to reduce friction upon the sphere while sliding along the launching tube 10.

After the sphere 50A is ejected, then go to Step 1 to turn the push rod 21 back to the standby position, to close the valve 312, and then to perform Steps 2~5 for ejecting another sphere. By repeating the cycle of Steps 1~5, the spheres can be ejected continuously.

It should be explained that maneuvering of the first driving device 22, the pneumatic cylinder 32, the valve 312, the second driving device 43 and the third driving device 45 can be regulated by a computer or a specific program. In addition, the magnitude of forcing to eject the sphere is determined by a volume of the air container 33 and a pressure of the air entering the aie container 33.

In summary, the sphere-launching apparatus provided by the present invention applies a push rod to push the sphere to a better place that can ensure the initial launch position and launch velocity of the sphere.

While the present invention has been particularly shown and described with reference to a preferred embodiment, it will be understood by those skilled in the art that various changes in form and detail may be without departing from the spirit and scope of the present invention.

What is claimed is:

1. A sphere-launching apparatus, comprising:

a launching tube, having a first axial end and a second axial end located oppositely to the first axial end, defining thereinside a launching passage connecting spatially the first axial end and the second axial end, wherein the launching tube is connected with a sphere-supplying unit in a bifurcation manner, and the sphere-supplying unit includes:

a sphere-supplying duct, for carrying a plurality of the spheres, connected spatially with the launching passage; and a stop block, mounted to a junction of the sphere-supplying duct and the launching passage, being movable between a block position and an open position; wherein, when the stop block is at the block position, a spatial connection of the sphere-supplying duct and the launching tube is terminated; wherein, when the stop block is at the open position, the spatial connection of the sphere-supplying duct and the launching tube is resumed so as to allow one of the plurality of the spheres in the sphere-supplying duct to fall into the launching passage;

a push unit, mounted to the first axial end, including:

a push rod, for protruding axially into the launching passage by extending parallel to the launching tube, having a third axial end and a fourth axial end located oppositely to the third axial end, the fourth axial end being to contact and push a sphere in the launching tube; and a first driving device, connected with the third axial end of the push rod, being to control the push rod to move axially in the launching passage so as further to push the sphere to a predetermined position; and a pneumatic unit, including:

a valve mechanism, having an air-emitting end connected spatially with the launching passage;

a pneumatic cylinder, connected with another end of the valve mechanism located oppositely to the air-emitting end thereof, being to drive the valve mechanism to block or open the air-emitting end; and an air container, for storing a compressed air, connected with the valve mechanism; wherein, when the valve mechanism opens the air-emitting end, the compressed air stored in the air container is discharged into the launching passage so as to eject the sphere out of the launching tube via the second axial end.

2. The sphere-launching apparatus of claim 1, wherein the first driving device controls the push rod in the launching passage to move axially between a standby position and a push position; wherein, when the push rod is at the standby position, the fourth axial end is located in the sphere-supplying duct at one side of a projection region of a junction of the sphere-supplying duct and the launching passage by closing to the first axial end; wherein, when the push rod is at the push position, the fourth axial end is located in the sphere-supplying duct at another side of the projection region of the junction of the sphere-supplying duct and the launching passage by closing to the second axial end.

3. The sphere-launching apparatus of claim 1, wherein the valve mechanism includes:

a casing, having an end forming the air-emitting end, the pneumatic cylinder being mounted to another end of the casing located oppositely to the air-emitting end; and a valve, located in the casing, having an end connected with the pneumatic cylinder while another end thereof is faced to the air-emitting end, the pneumatic cylinder driving the valve to move with respect to the air-emitting end so as to block or open the air-emitting end.

4. The sphere-launching apparatus of claim 1, wherein the valve mechanism has a compressed-air injection hole for introducing the compressed air into the valve mechanism and then the air container.

5. The sphere-launching apparatus of claim 1, wherein the valve mechanism is connected with one end of an air passage, another end of the air passage is connected spatially with the launching passage, and the air passage is axially perpendicular to the launching tube.

6. The sphere-launching apparatus of claim 5, wherein the push rod is furnished with a neck section; wherein, when the push rod pushes the sphere to the predetermined position, the neck section is positioned right under a junction of the air passage and the launching passage.

7. The sphere-launching apparatus of claim 1, wherein the stop block is connected with a second driving device, and the second driving device controls the stop block to displace between the block position and the open position.

8. The sphere-launching apparatus of claim 1, wherein the sphere-supplying duct is furnished with a stop rod, and the stop rod is movable axially between a protruding position and a retrieving position; wherein, when the stop rod is at the protruding position, the plurality of the spheres are jammed in the sphere-supplying duct; wherein, when the stop rod is at the retrieving position, one of the plurality of the spheres in the sphere-supplying duct is allowed to fall into the launching passage.

9. The sphere-launching apparatus of claim 8, wherein the stop rod is axially perpendicular to the sphere-supplying duct, the stop rod is connected with a third driving device, and the third driving device controls the stop rod to displace between the protruding position and the retrieving position.

* * * * *